US005394841A

United States Patent [19]

Murakami

[11] Patent Number: 5,394,841

[45] Date of Patent: Mar. 7, 1995

[54] CONTROL DEVICE FOR VALVE SYSTEM IN AUTOMOBILE ENGINE

[75] Inventor: Nobuaki Murakami, Kyoto, Japan

[73] Assignee: Mitsubishi Jidosha Kogyo Kabushiki Kaisha, Tokyo, Japan

[21] Appl. No.: 141,571

[22] Filed: Oct. 27, 1993

[30] Foreign Application Priority Data

Oct. 30, 1992 [JP] Japan ..... 4-292705

[51] Int. Cl.[6] ..... F01L 1/34

[52] U.S. Cl. ..... 123/90.15; 123/90.16; 123/90.12

[58] Field of Search ..... 123/90.12, 90.15, 90.16, 123/90.17, 90.22, 90.39, 90.4

[56] References Cited

U.S. PATENT DOCUMENTS

| | | | |
|---|---|---|---|
| 4,429,853 | 2/1984 | Chaffiotte et al. | 123/90.16 |
| 4,724,802 | 2/1988 | Ishii | 123/90.16 |
| 4,768,475 | 9/1988 | Ikemura | 123/90.16 |
| 4,844,023 | 7/1989 | Konno et al. | 123/90.16 |
| 4,848,285 | 7/1989 | Konno et al. | 123/90.16 |
| 4,883,027 | 11/1989 | Oikawa et al. | 123/90.16 |
| 4,899,701 | 2/1990 | Inoue et al. | 123/90.16 |
| 4,901,685 | 2/1990 | Fukuo et al. | 123/90.16 |
| 4,962,732 | 10/1990 | Inoue et al. | 123/90.16 |
| 5,099,806 | 3/1992 | Murata et al. | 123/90.16 |
| 5,143,030 | 9/1992 | Ikeura | 123/90.16 |
| 5,143,037 | 9/1992 | Sawamoto | 123/90.16 |
| 5,150,675 | 9/1992 | Murata | 123/193.5 |
| 5,186,128 | 2/1993 | Murata et al. | 123/90.16 |
| 5,195,470 | 3/1993 | Ikeura | 123/90.16 |

*Primary Examiner*—E. Rollins Cross
*Assistant Examiner*—Weilun Lo

[57] ABSTRACT

A control device for a valve system in which low or high speed cams can be smoothly changed. The control device comprises: a valve system including low and high speed cam selecting means for activating and deactivating intake or exhaust valves; and a control unit for calculating, based on engine operation data, a target engine speed to provide a cam selecting signal to the low and high speed cam selecting means, a variation of the engine speed based on the engine speed data, a corrected target engine speed based on the engine speed variation, target engine speed, and delay time of the operation of the cam selecting means, and activating the cam selecting means at the corrected target engine speed.

6 Claims, 8 Drawing Sheets

CONTROL DEVICE FOR VALVE SYSTEM IN AUTOMOBILE ENGINE

FIELD OF THE INVENTION

This invention relates to an improved control device which includes a mechanism for enabling a valve system to selectively operate low or high speed cams and activate or inactivate intake or exhaust valves by the selected low or high speed cams in an automobile engine, so that the intake or exhaust valves are operated in a desired target operation mode.

BACKGROUND OF THE INVENTION

There are known a number of automobile engines which include: a valve operating mechanism for selectively operating low or high speed cams and operating valves by the selected cams at proper timings so as to increase an engine output; or a valve operating mechanism for selectively operating low or high speed cams, operating valves by the selected cams, and allowing a partial cylinder operation mode by disconnecting a portion of the engine cylinders and suspending fuel supply to the disconnected cylinders, thereby increasing the engine output and reducing the fuel consumption.

A control device for such a valve operating mechanism sets various operation modes according to information concerning the operation status of the engine. For instance, in a low speed operation mode, low speed cams are used to operate the intake and exhaust valves so as to increase volume efficiency. In a high speed operation mode, high speed cams are used to operate the intake and exhaust valves so as to increase the volume efficiency.

The low or high speed cams are selectively operated in response to a cam selecting signal sent to the valve operating mechanism. Either the low or high speed cams are activated when the engine is operating at a target speed DN for selecting the low or high speed mode (called "target engine speed DN" hereinafter). The cam selecting signal is issued when the engine is operating at a given speed which is set with reference to an ordinary running condition. When the cam selecting signal is issued at the target engine speed DN while the engine is operating at a relatively low speed, either the low or high speed cams can be selectively operated without any trouble or delay. This is because the valve operating mechanism is very responsive to the cam selecting signal under such a condition.

Conversely, when the engine is idling or when the engine speed is abruptly increased due to acceleration during the operation of a low speed gears, the valve operating mechanism is slow to respond to the cam selecting signal. In such a case, the engine speed would exceed the target engine speed DN for the desired operation mode, the valve operating mechanism would fail to follow the operation mode changing, or an engine torque would become too large.

SUMMARY OF THE INVENTION

According to the invention, there is provided a control device for a valve system to selectively operate low or high speed cams and activate valves by the selected cams in an automobile engine. The control device comprises: first rocker arms to be operated by low speed cams and for activating at least intake or exhaust valves; second rocker arms to be operated by high speed cams; pin members for coupling or decoupling the first and second rocker arms and being biased by spring members; an oil pump for moving the pin member against the spring member; solenoid valves for changing routes of pressured oil from the oil pump; and a control unit for controlling the solenoid valves based on a time-dependent variation of an engine speed.

The control unit comprises: target engine speed calculating means for calculating a target engine speed at which a cam selecting signal is sent to cam selecting means; engine speed variation calculating means for calculating a variation of the engine speed; and corrective engine speed calculating means for calculating an engine speed for sending the cam selecting signal based on the variation of the engine speed. Thus, the cam selecting means will be activated at the corrected target engine speed which is responsive to the variation of the engine speed.

DETAILED DESCRIPTION OF THE PREFERRED EMBODIMENTS

Figure 1:
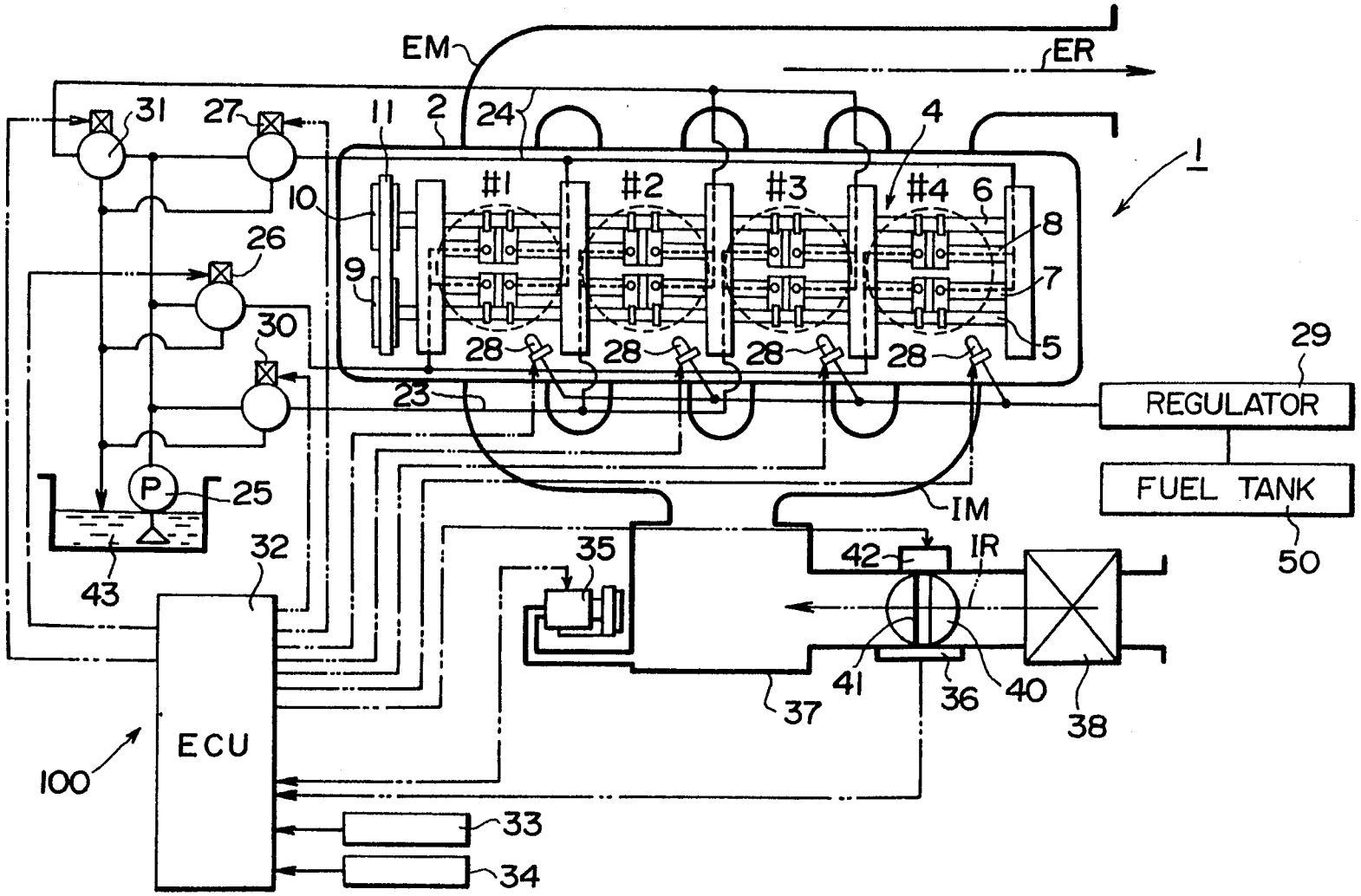
FIG. 1 is a schematic view showing the configuration of a control device for a valve system including low and high speed cam selecting means in an automobile engine, according to a first embodiment of the invention.

Referring to FIG. 1, a control device 100 according to a first embodiment of the invention is applied to an in-line four-cylinder engine 1 including a DOCH type valve system.

The engine 1 includes, on its cylinder head 2, an intake manifold IM communicating with respective cylinders, an intake pipe IR communicating with a surge tank 37, an exhaust manifold EM communicating with the cylinders, and an exhaust pipe ER connected to the exhaust manifold EM.

A throttle valve 40 is located behind an air cleaner 38 in the intake pipe IR. A rotary shaft 41 of the throttle valve 40 is rotated by an actuator 42 including a step motor. The actuator 42 is connected to and is controlled by an engine control unit ECU 32 to be described later. A negative pressure sensor 35 is attached to the surge tank 37 in the intake pipe IR.

Figure 2:
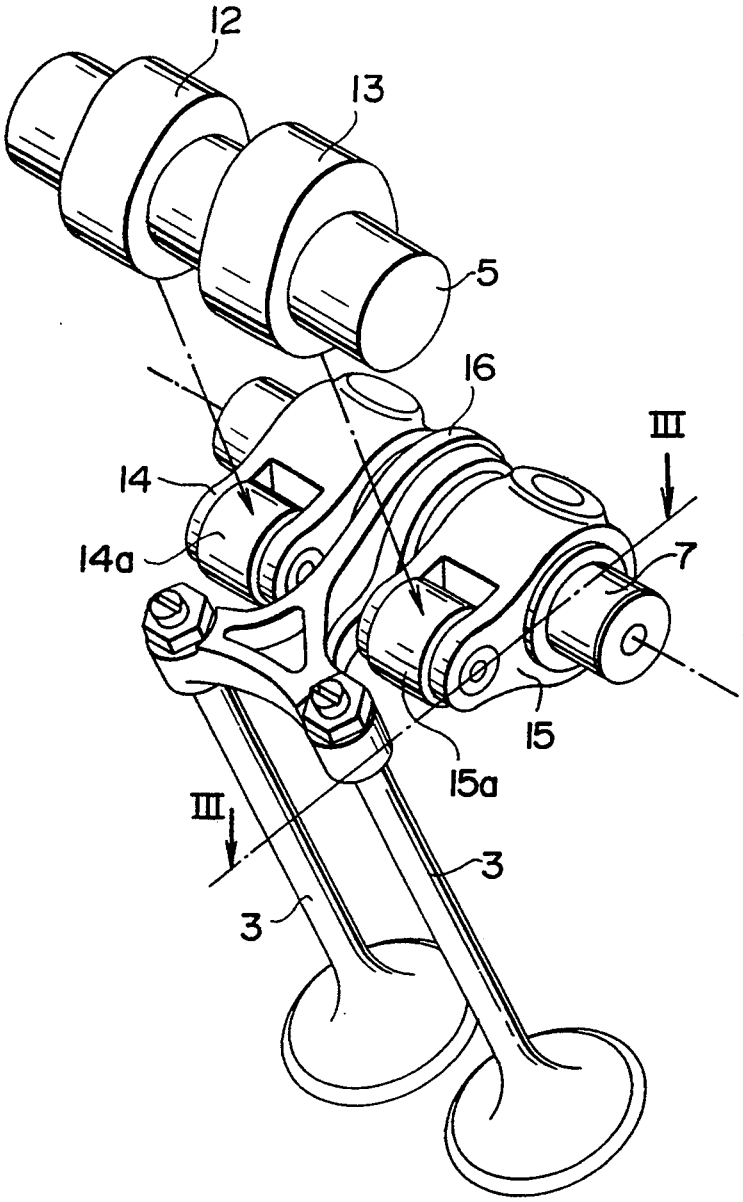
FIG. 2 is a perspective view of a part of a valve system in the automobile engine of FIG. 1.
Figure 3:
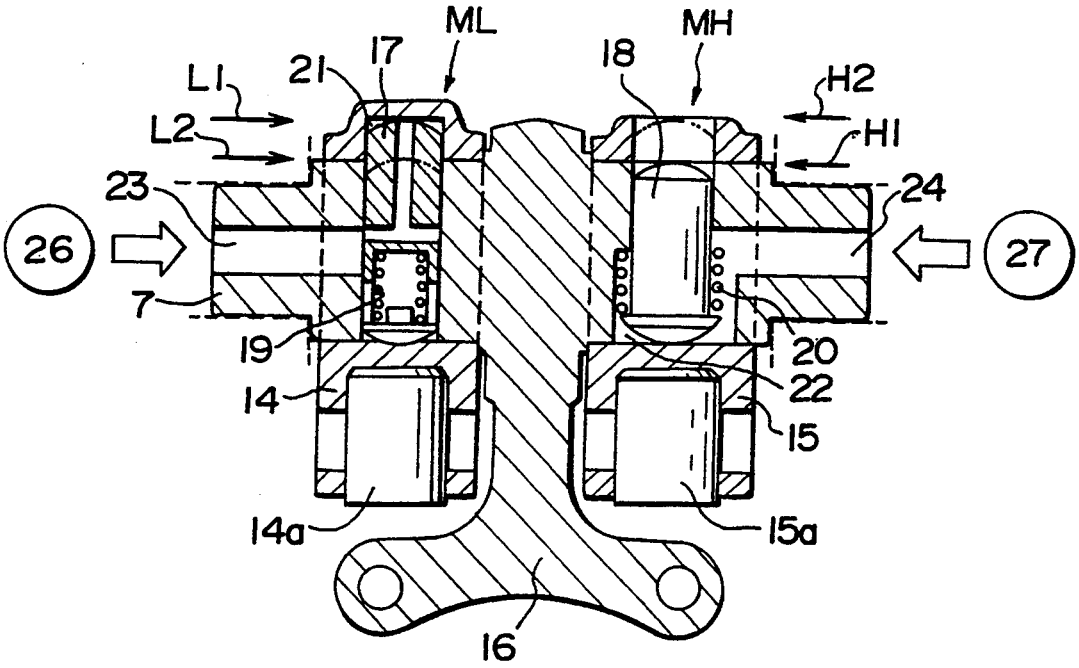
FIG. 3 is a cross-sectional view taken along line III—III in FIG. 2.
Figure 4:
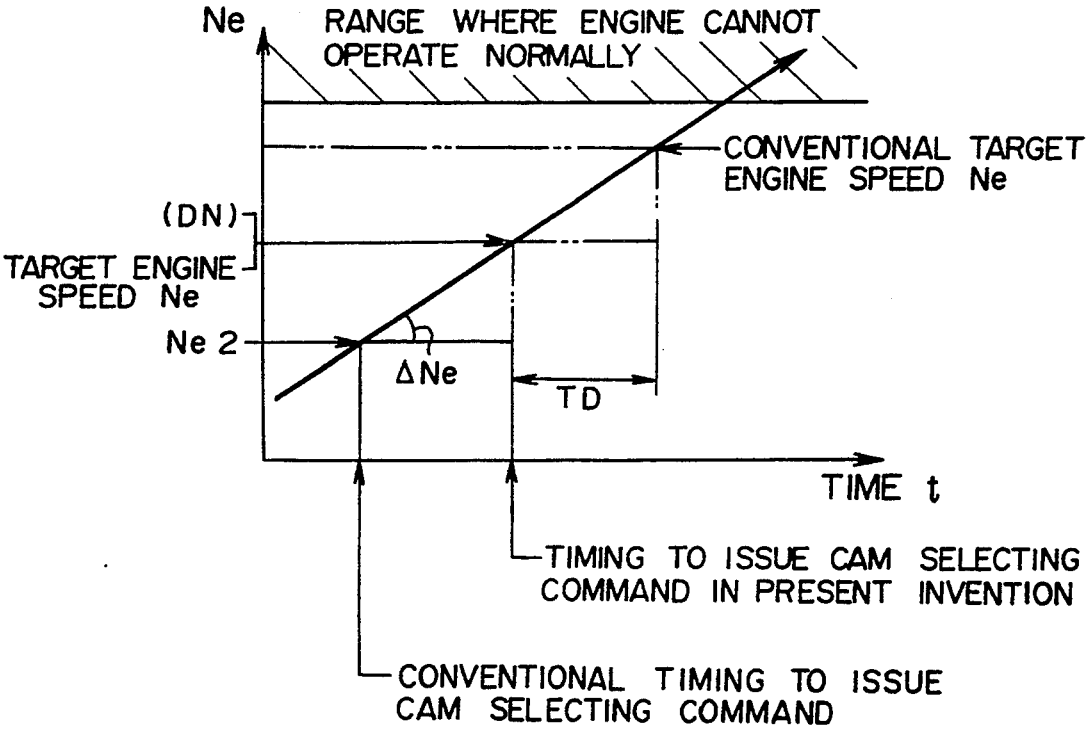
FIG. 4 is a graph showing timings at which a cam selecting signal is issued by the control device of the invention.

Intake and exhaust ports (not shown) are opened and closed by intake valves (one example is shown in FIG. 2) and exhaust valves, respectively. The intake and exhaust valves are operated by the valve system 4 of the DOHC type. The valve system 4 comprises intake and exhaust cam shafts 5 and 6, and intake and exhaust rocker shafts 7 and 8, which are installed on the cylinder head 2. The cam shafts 5 and 6 have timing gears 9 and 10 as integral parts at their ends, respectively. The timing gears 9 and 10 are connected to a crankshaft (not shown) via a timing belt 11 so that the camshafts 5 and 6 are rotated at half engine speed. The intake and exhaust rocker shafts 7 and 8 are separately provided for the respective cylinders.

The intake and exhaust valves of all the cylinders are opened and closed by the valve system 4. As shown in FIG. 2, a part of the valve system 4 associated with the intake valves includes a low speed rocker arm 14 (as a first rocker arm) operated by a low speed cam 12, a high speed rocker arm 15 (as a second rocker arm) operated by a high speed cam 13, and a rocker shaft 7 for pivotally supporting the rocker arms 14 and 15 thereon, and a T-shaped lever 16 which is integral with the rocker shaft 7.

The T-shaped lever 16 is forked at one end thereof. A pair of intake valves 3 are coupled to the forked ends of the T-shaped lever 16, and are opened and closed by the T-shaped lever 16. The low and high speed rocker arms 14 and 15 have rollers 14*a* and 15*a* rotatably received in their rotary ends. The low and high speed cams 12 and 13 come into contact with the rollers 14*a* and 15*a*, respectively. The low and high speed rocker arms 14 and 15 have low and high speed cam selecting means ML and MH at opposite ends, respectively. The low and high speed cam selecting means ML and MH constitute a main part of the valve operating mechanism.

The cam selecting means ML comprises a pin 17 housed in a cavity of the rocker shaft 7, an oil pressure chamber 21 for operating the pin 17 with oil pressure against a resilient force of the spring 19, an oil path 23 communicating with an oil pressure chamber 21, and a solenoid valve 26 for the cylinders #1 and #4 and for intermittently connecting the oil path 23 to an oil pump 25, and a solenoid valve 27 for the cylinders #1 and #4 for intemittently connecting the oil path 24 to the oil pump 25. Similarly, the cam selecting means MH comprises a pin 18 housed in another cavity of the rocker shaft 7, an oil pressure chamber 22 for operating the pin 18 with oil pressure against a resilient force of the spring 20, an oil path 24 communicating with the oil pressure chamber 22, a solenoid valve 30 for the cylinders #2 and #3 and for intermittently connecting the oil path 23 to the oil pump 25, and a solenoid valve 31 for the cylinders #2 and #3 and for intermittently connecting the oil path 24 to the oil pump 25. The oil pump 25 communicates with the fuel tank 50 shown in FIG. 1.

The solenoid valves 26, 30, 27 and 31 are three-way valves functioning as oil control valves (OCV). When actuated, these solenoid valves supply pressured oil to the oil pressure chambers 21 and 22. Conversely, when remaining inactive, these solenoid valves connect the oil pressure chambers 21 and 22 to a drain. These valves are controlled by the engine control unit ECU 32.

In the cam selecting means ML, when the solenoid valves 26 and 30 are inactive, the resilient forces of the spring 19 acts, and the low speed rocker arm 14 becomes integral with the T-shaped lever 16 via the pin 17 at the locked position L1, and operates the intake valves 3 in the low speed mode. On the other hand, in the cam selecting means MH, when the solenoid valves 27 and 31 are inactive, the resilient force of the spring 20 acts to move the pin 18 to the nonlocked position H1.

When the solenoid valves 26 and 30 are active, the pin 17 is moved to the non-locked position L2 against the force of the spring 19 in the cam selecting means ML. On the other hand, when the solenoid valves 27 and 31 are active, the pin 18 is moved to the locked position H2 against the force of the spring 20 in the cam selecting means MH. Thus, only the high speed rocker arm 15 becomes integral with the T-shaped lever 16, thereby operating the intake valves in the high speed mode.

Referring to FIG. 1, fuel injectors 28 are disposed on the cylinder head 2 so as to supply fuel to intake ports (not shown) of the respective cylinders. The fuel injectors 28 receive the fuel from the fuel tank 50 via a regulator 29 for regulating the fuel to a preset pressure. Fuel injection is controlled by the engine control unit ECU 32.

The engine control unit ECU 32 mainly comprises a microcomputer, and performs various control functions such as detecting, based on operation mode data, whether the engine is in the low speed operation mode using the low speed cam or in the high speed operation mode using the high speed cam, issuing a signal indicative of the detected operation mode, and controlling outputs for each operation mode, the operation of the fuel injectors, and ignition timings.

Further, the ECU 32 functions as the following means: target engine speed calculating means which calculates, based on the engine speed Ne and negative intake pressure in an intake pipe, a target engine speed DN at which the cam selecting signal should be sent to the cam selecting means; engine speed variation calculating means for calculating a variation ΔNe of the engine speed Ne based on the engine speed Ne; corrected engine speed calculating means for calculating an engine speed Ne2 for sending the cam selecting signal (called "corrected target engine speed Ne2") based on the variation ΔNe of the engine speed, the target engine speed DN, and delay time TD indicative of delayed operation of the cam selecting means. The low or high speed cams are selectively operated in response to the cam selecting signal which is issued at the corrected target engine speed Ne2.

As shown in FIG. 1, the ECU 32 receives various operation data such that the engine speed Ne from an engine speed sensor 33 (i.e. a crank angle sensor), a cooling water temperature Twt from a temperature sensor 34, a negative intake pressure Pb from a negative pressure sensor 35, and a throttle opening 8s from a throttle opening sensor 36.

The operation of the control device of the present invention will be described with reference to control programs shown in FIGS. 5 to 7.

Figure 5:
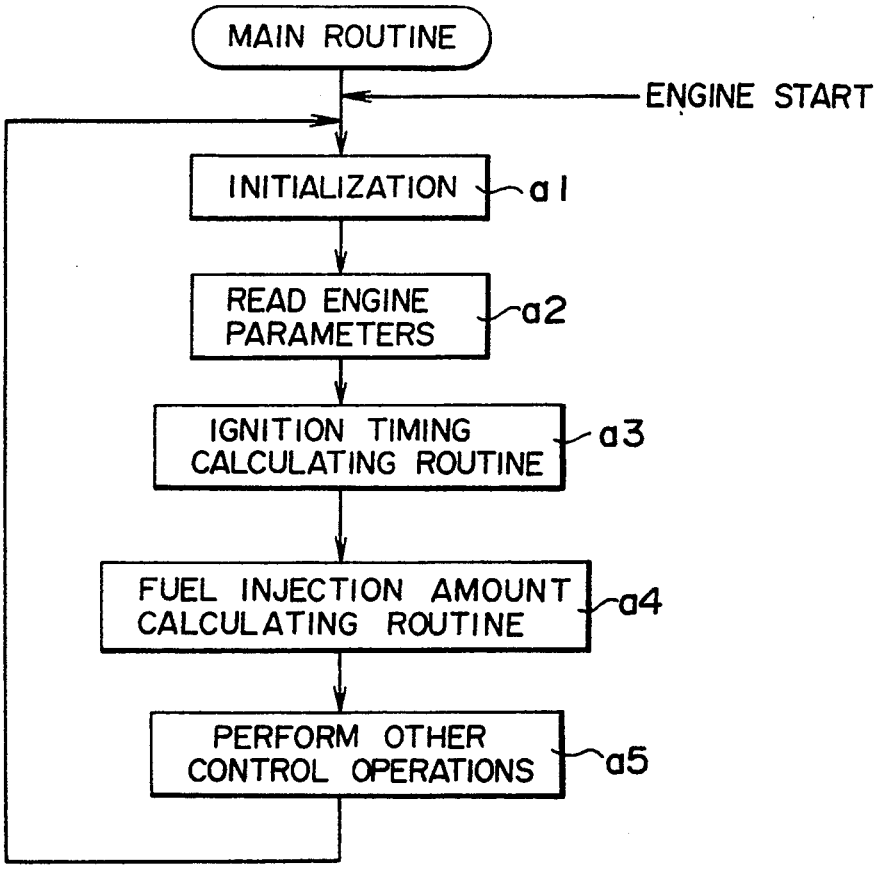
FIG. 5 is a flow chart of a main routine of the control device.

Referring to FIG. 5, the actuation of the main switch allows the ECU 32 to perform its control operations according to the main routine.

In step al, the ECU 32 checks various functions, performs initialization, and goes to step a2. In step a2, the ECU 32 reads various engine operation data, and stores data such as the engine speed Ne and negative intake pressure Pb. Then, the ECU 32 advances to steps a3, a4 and a5, where it controls the ignition timing, fuel injection timings, and so on. Under this condition, the solenoid valves 26, 30, 27 and 31 remain inactive, so that the engine E is in the low speed operation mode by means of the low speed cams.

Figure 6:
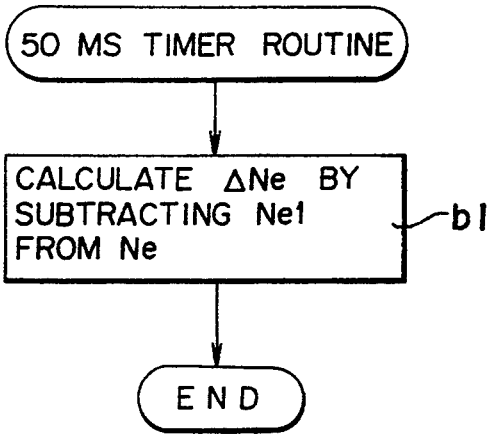
FIG. 6 is a flow chart of a ΔNe calculating routine of the control device.
Figure 7:
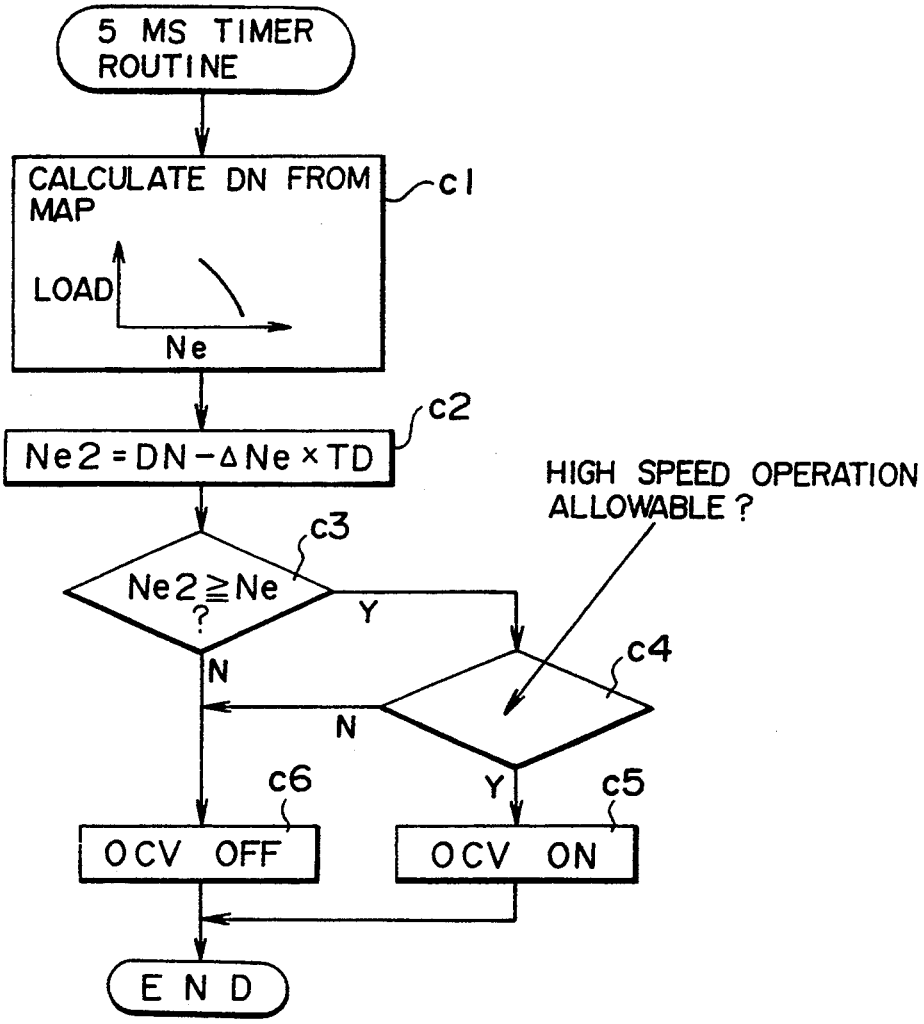
FIG. 7 is a flow chart of a ΔNe2 calculating routine of the control device.

During the control operation in the main routine, the ECU 32 performs the ΔNe calculating routine and the Ne2 calculating routine at every 50 milliseconds and at every 5 milliseconds, respectively, as shown in FIGS. 6 and 7. At every 50 milliseconds in the main routine, the ΔNe calculating routine is started. In this routine, the ECU 32 subtracts the previous engine speed Ne1 from the current engine speed Ne to obtain the variation ΔNe of the engine speed, and stores the variation ΔNe.

At every 5 milliseconds in the main routine, the Ne2 calculating routine is carried out. In step c1, the target engine speed DN is calculated by using a map which is plotted based on the engine speed Ne and the negative intake pressure Pb, and is stored in the ECU 32. Then, the ECU 32 goes to step c2.

In step c2, the ECU 32 subtracts the product of the engine speed variation ΔNe and delay time TD from the target engine speed DN, thereby obtaining the corrected target engine speed Ne2. In other words, the cam selecting signal is issued at the corrected target engine speed Ne2 which precedes the target engine speed DN by the period corresponding to the estimated delay time TD, so that the low or high speed selecting means can be activated exactly at the target engine speed DN.

In step c3, the ECU 32 compares the corrected target engine speed Ne2 with the current engine speed Ne. When Ne2≧Ne, the ECU 32 goes to step c4, where it checks whether engine E completes its start-up and is stable and suitable for the high speed operation mode. When the engine E is judged to be stable, the ECU 32 activates the solenoid valves 26, 30, 27 and 31, and changes the low speed cam over to the high speed cam. Conversely, when Ne2≦Ne in step c3, the ECU 32 judges that the engine is just after its startup and is too unstable to perform the high speed operation, and advances to step c6. Under this condition, the solenoid valves 26, 30, 27 and 31 are kept inactive.

In the present invention, the cam selecting means are used to selectively operate the high or low speed cams. Alternatively, it is also possible to carry out the partial cylinder operation mode as follows: only the solenoid valve 26 for disconnectable #1 and #4 cylinders is activated to move the pin 17 to the non-locked position by the force of the oil pressure chamber 21 and the resilient force of the spring 20, and keep the T-shaped lever 16 inactive.

Figure 9:
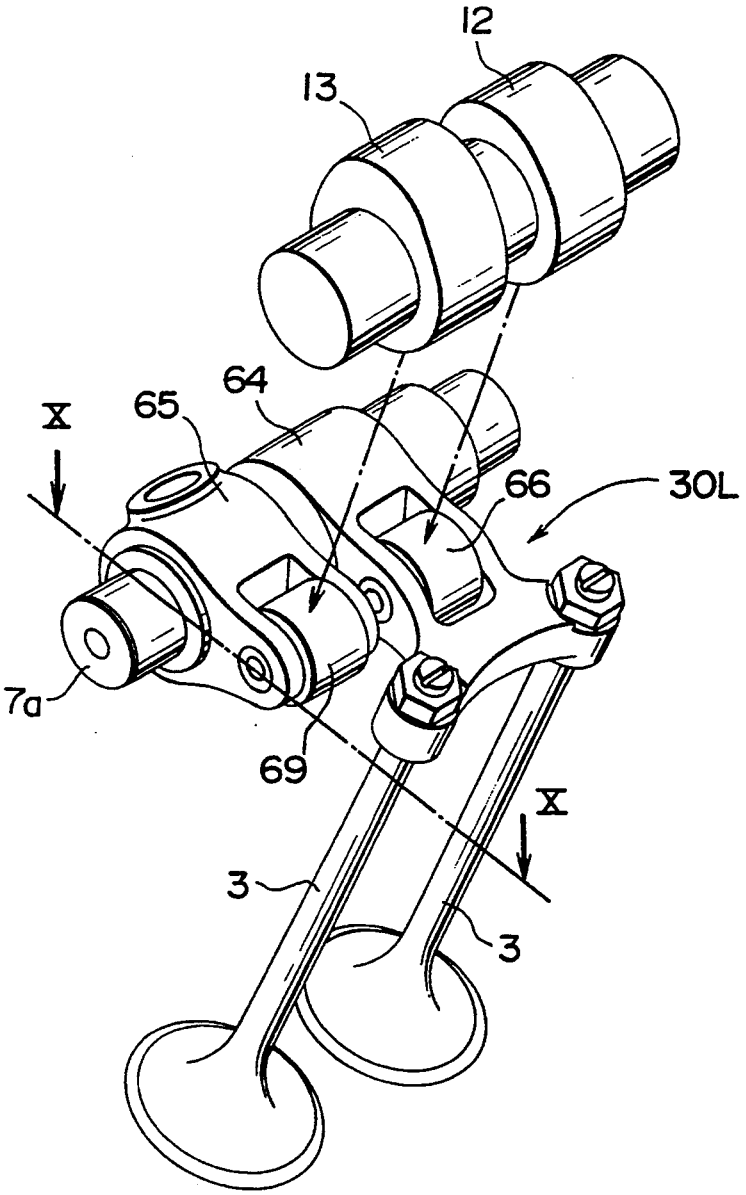
FIG. 9 is a view similar to FIG. 2 showing a valve system according to a second embodiment of the invention.
Figure 10:
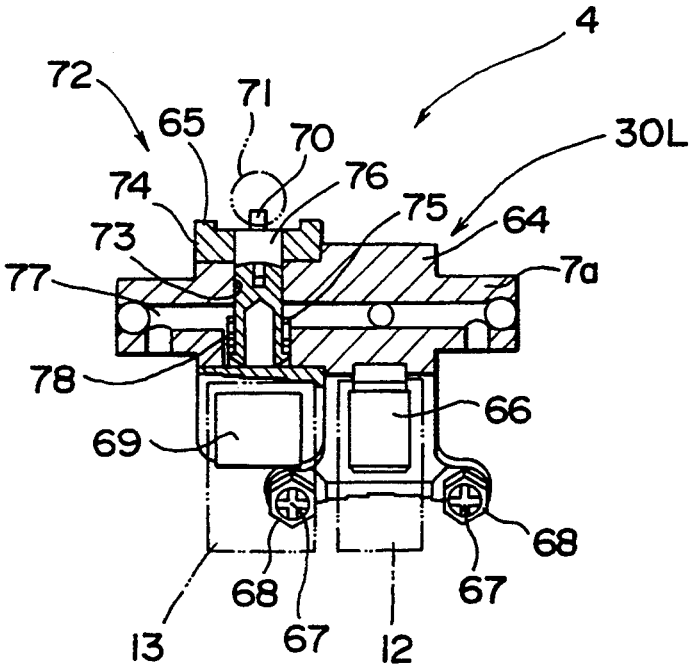
FIG. 10 is a cross-sectional view taken along line X—X in FIG. 9.

The four solenoid valves 26, 30, 27 and 31 are used in the foregoing embodiment. Alternatively, the solenoid valves 26 and 30 are combined into one, and the valves 27 and 31 are also combined into one. Then, the oil paths 23 and 24 may be merged. In addition, the low and high speed cam selecting means for #2 and #3 cylinders, or for all the four cylinders may be replaced with cam selecting means shown in FIG. 9 as a second embodiment. Specifically, a valve system 4 of FIG. 9 comprises a T-shaped lever 30L (serving as the first rocker arm) and a high speed rocker arm 65 (serving as the second rocker arm). The T-shaped lever 30L includes a rocker shaft *7a*, a low speed arm member 64 and forked ends as integral parts. The low speed arm member is integral with the rocker shaft *7a* and has a roller bearing 66 at its one end. The low speed cam 12 comes into contact with the roller bearing 66. The T-shaped lever 30L has adjust screws and adjust nuts 68 attached at the forked ends. The adjust screws 67 are coupled, at their ends, to intake or exhaust valves at their upper ends.

The high speed rocker arm 65 is rotatably supported on the rocker shaft 7a, and has a roller bearing 69 at one end thereof. The high speed cam 13 comes into contact with the roller bearing 69. The high speed rocker arm 65 also includes an arm member 70 as an integral part at the other end opposite to the roller bearing 69. An arm spring 71 acts on the arm member 70 in such a manner that the high speed rocker arm 65 is urged toward the high speed cam 13. Further, cam selecting means 72 allows the high speed rocker arm 65 to rotate integrally with the rocker shaft *7a*. Specifically, the rocker shaft *7a* has a cavity 73 at a position thereof associated with the high speed rocker arm 65. A pin 74 is movable in the cavity 73, and is supported and biased by a spring member 75. The high speed rocker arm 65 has a cavity 76. The pin 74 is disengaged from the cavity 76 by the spring member 75. A pressured oil path 77 is axially formed in the rocker shaft *7a* to communicate with the cavity 73. An oil path 78 is formed near the bottom of the cavity 76, and communicates with the cavity 76.

Normally, in the high speed rocker arm 65, the pin 74 remains free from the cavity 76 by the spring member 75, so that the high speed rocker arm 65 is disengaged from the rocker shaft *7a* and is not rotatable with the rocker shaft *7a*. Thus, the low and high speed cams 12 and 13 rock the low speed arm 64 and the high speed rocker arm 65, respectively. The force of the low speed cam 12 is transmitted to the intake valves 3, thereby rocking the intake valves 3. Then, the pressured oil is supplied from the oil pump 25 to the oil path 77 in the rocker shaft *7a* via the solenoid valve 26 or 30. In the high speed rocker arm 65, the pressured oil flows via the oil path 78 to the bottom of the cavity 73, thereby engaging the pin 74 with the cavity 76. Thereafter, the high speed rocker arm 65 engages with the rocker shaft *7a*, and rotates integrally with the rocker shaft *7a*. Thus, the high speed cam 13 rocks the high speed rocker arm 65, of which force is transmitted to the intake valves 3 via the rocker shaft *7a* and the low speed arm portion 64, and activates the intake valves 3.

In the first embodiment of the invention, the corrected target engine speed Ne2 is calculated by using the variation ΔNe of the engine speed derived by subtracting the previous engine speed Ne1 from the current engine speed Ne. Alternatively, an engine speed increasing ratio ΔNe1 derived in the routine shown in FIG. 8 may be used in place of ΔNe in the second embodiment.

Figure 8:
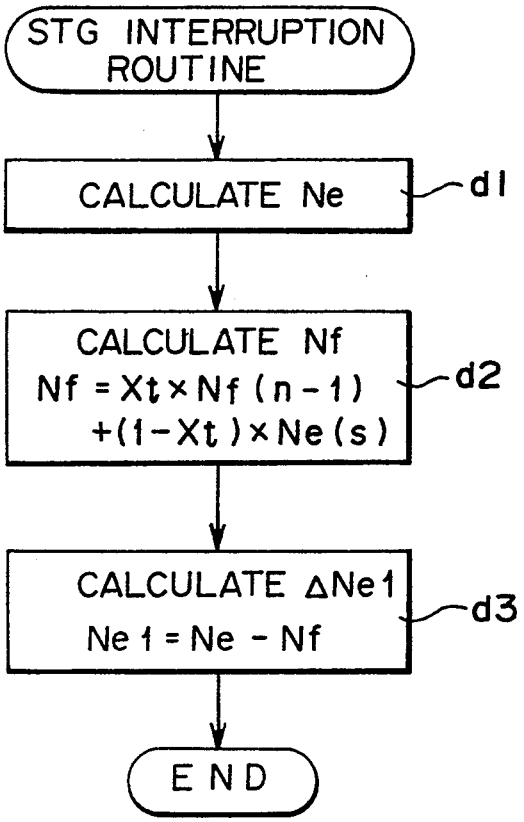
FIG. 8 is a flow chart of a routine for calculating an engine speed increasing rate ΔNe1.

In the routine shown in FIG. 8, the ECU 32 reads the current engine speed Ne from the engine speed sensor 34 in step d1. In step d2, a filtering speed Nf is calculated by adding the previous filtering speed Nf(n−1) multiplied by a filtering constant Xt, and the present engine speed Ne(S) multiplied by (1−Xt) [i.e. $Nf = Xt \times Nf(n-1) + (1-Xt) \times Ne(S)$]. In step d3, the engine speed increasing ratio ΔNe1 is derived by subtracting the filtering speed Nf from the current engine speed Ne. The engine speed increasing ratio ΔNe1 is relatively gentle compared with the corrected target engine speed ΔNe. In other words, since the filtering speed Nf is adjusted by the filtering constant Xt, the engine speed increasing ratio ΔNe1 is averaged. The corrected target engine speed Ne2 is calculated by using ΔNe1 so that Ne2 is set relatively in a wide range by the amount in which the ΔNe is averaged. Thus, the low or high speed cams can be smoothly changed to the high or low speed cam while the engine speed is maintained below the target engine speed DN at which the cam selecting means is activated, thereby suppressing noise produced during the cam selection.

The control device of the invention can correct the timing to provide the cam selecting signal to the cam selecting means in response to a varying engine speed increasing ratio. Therefore, a desired cam selecting means can be always activated at the target engine speed, so that the cam selecting means can operate without trouble for a long period of time and variation of an engine torque can be suppressed.

The invention being thus described, it will be obvious that the same may be varied in many ways. Such variations are not to be regarded as a departure from the spirit and scope of the invention, and all such modification as would be obvious to one skilled in the art are intended to be included within the scope of the following claims.

What is claimed is:

1. A control device for a variable valve-operating system of an engine having a plurality of cylinders, comprising:

at least one hydraulic actuator for changing characteristics of movement of at least one of an intake valve and an exhaust valve of the engine;

an oil pump for providing pressurized oil to said at least one hydraulic actuator;

at least one solenoid valve for controlling pressurized oil from said oil pump to said at least one hydraulic actuator; and control unit means for controlling said at least one solenoid valve, said control unit means being a control unit including: target engine speed setting means for setting a target engine speed for changing characteristics movement of said at least one of intake valve and exhaust valve; engine speed variation calculating means for calculating a variation of the engine speed on the basis of engine speed data; and corrected target engine speed calculating means for calculating a corrected target engine speed at which a signal for changing characteristics of movement of said at least one of intake valve and exhaust valve is sent to said at least one solenoid valve on the basis of the variation of the engine speed and a set value corresponding to a delay time of operation of said at least one hydraulic actuator;

whereby said control unit means operates said at least one solenoid valve at the corrected target engine speed.

2. The control device as in claim 1, further comprising rocker arms to be operated by an least one cam, and a valve-operating member coupled to said at least one of intake valve and exhaust valve, whereby said at least one hydraulic actuator couples and decouples said rocker arms relative to said valve-operating member, and said at least one of intake valve and exhaust valve is opened by said at least one cam when said rocker arms are coupled to said valve-operating member.

3. The control device as in claim 2, wherein said intake or exhaust valves are disabled when said rocker arms are decoupled from said valve-operating member.

4. The control device as in claim 2, wherein said cam for operating said rocker arms is a high speed cam, said valve-operating member is operated by at least one low speed cam, said at least one of intake valve and exhaust valve is opened by said high speed cam when said rocker arms are coupled to said valve-operating member, and said at least one of intake valve and exhaust valve is opened by said low speed cam when said rocker arms are decoupled from said valve-operating member.

5. The control device as in claim 1, further comprising at least one first rocker arm to be operated by at least one high speed cam, at least one second rocker arm to be operated by at least one low speed cam, and a valve-operating member coupled to said at least one of intake valve and exhaust valve, wherein said at least one hydraulic actuator includes a first actuator for coupling and decoupling said first rocker arm and said valve-operating member, and a second actuator for coupling and decoupling said second rocker arm and said valve-operating member, whereby said at least one of intake valve and exhaust valve is opened by said high speed cam when said first rocker arm is coupled to said valve-operating member, said at least one of intake valve and exhaust valve is opened by said low speed cam when said first rocker arm is decoupled from said valve-operating member and said second rocker arm is coupled to said valve-operating member, and said at least one of intake valve and exhaust valve is disabled when said first and second rocker arms are decoupled from said valve-operating member.

6. The control device as in claim 1, wherein when the corrected target engine speed is at least equal to a current engine speed, said at least one of intake valve and exhaust valve is operated by said high speed cam, and when the corrected engine speed is less than the current engine speed, said at least one of intake valve and exhaust valve is operated by said low speed cam.

* * * * *